United States Patent [19]

Cunningham

[11] 4,158,245

[45] Jun. 19, 1979

[54] SWIMMING DEVICE

[76] Inventor: Robert K. Cunningham, P.O. Box 8155, 600 Goff Mountain Rd., Nitro, W. Va. 25143

[21] Appl. No.: 865,288

[22] Filed: Dec. 28, 1977

[51] Int. Cl.[2] ..... A63B 35/00

[52] U.S. Cl. ..... 9/301; 115/22.2; 115/26.1; 115/26.3; 115/31

[58] Field of Search ..... 9/301; 115/21, 22.1, 115/22.2, 22.3, 25, 26.1, 26.3, 31, 11, 14; 417/539, 550; 46/95

[56] References Cited

U.S. PATENT DOCUMENTS

| | | | |
|---|---|---|---|
| 1,587,605 | 6/1926 | Scroggins | 115/26.1 X |
| 2,622,792 | 12/1952 | Ramclow | 417/550 |
| 3,918,388 | 11/1975 | Bernard | 9/301 X |

FOREIGN PATENT DOCUMENTS

| | | | |
|---|---|---|---|
| 1121341 | 7/1968 | United Kingdom | 115/31 |

*Primary Examiner*—Trygve M. Blix
*Assistant Examiner*—Sherman D. Basinger
*Attorney, Agent, or Firm*—Sughrue, Rothwell, Mion, Zinn and Macpeak

[57] ABSTRACT

A swimming device has a body platform with straps for the arms and body of a swimmer. Cylinders extend longitudinally on the platform and are open at their forward ends and have restricted outlet nozzles in the rear. Pistons are slidably mounted in the cylinders, and cables are secured to the pistons and to foot stirrups. The pistons are provided with flapper valves which open to permit fluid passage upon forward propulsion of the piston, and close to prevent such passage when the piston is on its backstroke, thereby forcing a water jet from the piston to propel the platform and swimmer forward.

4 Claims, 5 Drawing Figures

FIG 1
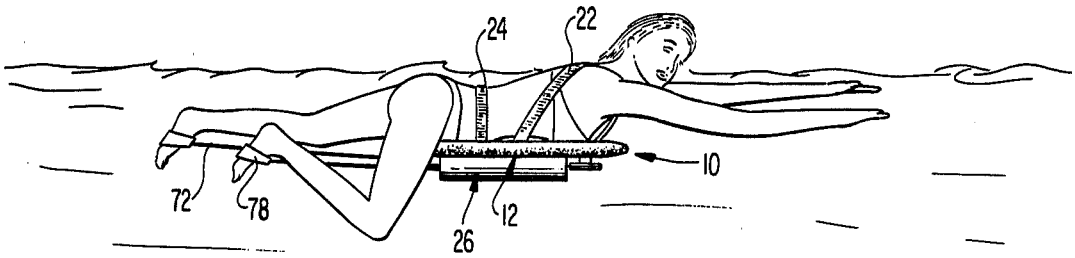
FIG 2
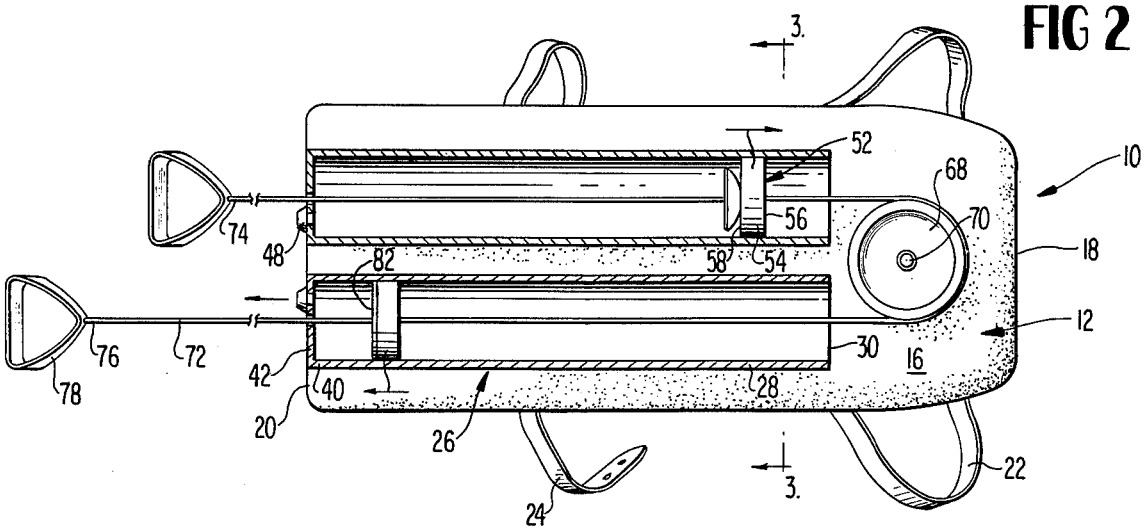
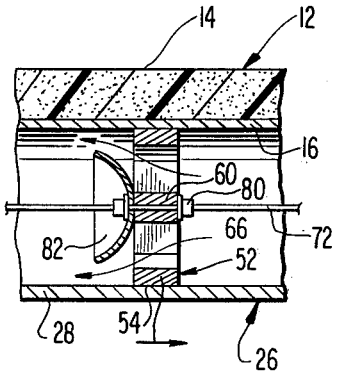
FIG 4
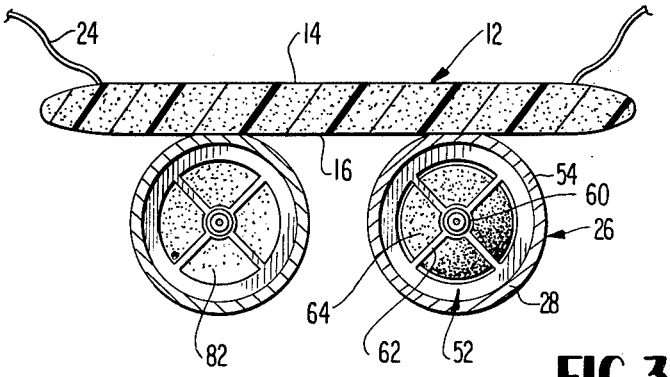
FIG 3
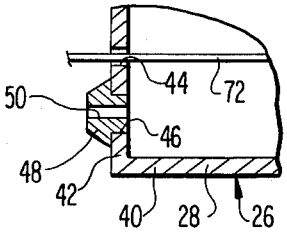
FIG 5

SWIMMING DEVICE

BACKGROUND OF THE INVENTION

1. Field of the Invention

This invention pertains to a device used by swimmers to improve efficiency and speed.

2. Statement of the Prior Art

Various devices used as swimming aids have heretofore been proposed. Representative of these are the below listed prior U.S. Patents:

| Patentee | Reg. No. | Date |
|---|---|---|
| C. M. Primm | 1,307,752 | June 24, 1919 |
| A. Sydoriak | 3,349,746 | Oct. 31, 1967 |
| A. Sydoriak | 3,505,970 | April 14, 1970 |
| Bernard | 3,918,388 | Nov. 11, 1975 |

SUMMARY OF THE INVENTION

The present invention provides a swimming device in which water jets are emmitted to increase the speed and ability of the swimmer. The device is useful as a general swimming aid, and finds particular utility in rescue operations and the like.

The device features a body attached platform with longitudinal cylinders. By leg action, the swimmer propels the pistons within the cylinders in alternating directions thereby forcing water jets from the cylinder alternatively to propel him forward through the water. With this unit, even relatively inexperienced swimmers can move very rapidly and for long distances through the water.

The invention is of non-complex construction and assembly, and is adapted for mass marketing.

Other and further objects and advantages of the invention will become apparent to those skilled in the art from a consideration of the following specifications when read in conjunction with the annexed drawing.

BRIEF DESCRIPTION OF THE DRAWING

FIG. 1 is an elevation view showing the device in use;

FIG. 2 is an enlarged top plan view;

FIG. 3 is a further enlarged sectional view taken on Line 3—3 of FIG. 2, looking in the direction of the arrows;

FIG. 4 is a detailed cross section through one of the pistons hereof; and

FIG. 5 is an enlarged sectional view showing the detail of the outlet nozzle and end wall.

DESCRIPTION OF THE PREFERRED EMBODIMENT

Referring to the drawing in more detail, a swimming device according to this invention is therein shown and identified generally by reference character 10. The device 10 comprises a buoyant body platform 12 constructed of light weight plastic or the like. Platform 12 has opposite top and bottom side surfaces 14 and 16, respectively, a leading end 18, and trailing end 20.

The platform is adapted to engage against the upper torso of the swimmer. It has a pair of arm loops 22 fixedly secured to the top side surface adjacent to leading end 18, and a body strap 24 at a midlength location which, as shown in FIG. 1, is buckled about the torso of the swimmer. A pair of elongated, substantially tubular, longitudinally extending cylinders 26 are fixedly mounted on the bottom side surface of the platform in side by side relationship. Each has a side wall 28 with an open forward end 30, and each is closed at its aft end 40 by an end wall 42. The end walls have central aperatures 44 formed therein for a purpose appearing below, and also have openings 46 spaced from the apertures. Seated in the openings 46 are fluid release jet nozzle 48 comprising plugs with outlet passageways 50.

Mounted for sliding movement in each of the cylinders is a piston 52. The pistons comprise a body having an annular side wall 54 in sliding contact with the cylinder wall 28, and having forward and aft ends 56, 58. The pistons further include a central hub 60, and radial spaced apart struts 62. Openings 64 between the struts provide fluid passage therebetween. The hubs, as shown in FIG. 4, have central openings 66 formed therein.

A pulley wheel 68 is rotatably mounted horizontal in fashion on a vertical axle 70 forwardly of the open ends 30 of the cylinders. An elongated cable 72 having ends 74 and 76 is trained about the pulley wheel, extends through the central opening 66 of the hubs, outwardly through the aperatures 44 of the end walls 42, and has foot stirrups 78 on the ends 74 and 76. At the pistons, clamp nuts 80 fixedly secure the cable thereto. Each of the pistons is provided with flap valve means comprising a disc 82 of rubber or other resilient material. The disks 82 are secured to the aft ends 58 of the pistons by the trailing clamp nut 80.

In operation, the swimmer positions himself on the platform and places his feet in the stirrups. He employs normal arm movements but pumps his legs alternately in forward and rearward directions. On the forward stroke, the flap 82 opens to permit the piston to readily move forward in the cylinder, but on the backstroke, the flap valve means closes the passage of water through the piston and thus emits a high pressure jet flow through the nozzle 48 causing the platform to be propelled forwardly.

I claim:

1. A swimming device comprising:

a buoyant body platform having opposite top and bottom side surfaces, and leading and trailing ends;

arm loops on the top side surface adjacent the leading end, and a body strap on said surface adjacent said trailing end;

a pair of longitudinally extending, tubular cylinders fixedly mounted on the bottom side surface;

each of said cylinders having an open forward end, and an aft end, the aft end having an end wall;

the end wall having central aperatures therein, and having an opening therein spaced from said central aperatures;

fluid release jet nozzles mounted in said openings;

a piston mounted for sliding movement in each of said cylinders, the piston having forward and aft ends, a side wall and sliding contact with the cylinders, and each having a central hub, and radial struts connecting the hub and the side wall and being opened between the struts to provide for fluid passage between the struts;

the hubs having central openings therein;

a pulley wheel mounted on the bottom side surface of the platform forward of the cylinders;

a cable trained about the pulley wheel, extending through the central openings of the hub and being fixedly secured thereto, and having cable ends which extend outwardly of the aft ends of the cylinders;

stirrups on the cable ends;

a flap valve formed of a resilient material on the aft ends of the piston to close the piston when propelled in the aft direction and to open to emit fluid passage when propelled forwardly.

2. A swimming device comprising:

a platform with top and bottom side surfaces and having means for body engagement thereon;

a pair of tubular cylinders mounted longitudinally on the platform;

the cylinders have aft end walls with fluid release nozzles and being open at their forward ends;

pistons slidably mounted in the cylinders;

a cable extending through the aft end walls and through the pistons and being secured to the pistons;

the pistons having fluid passages, and having flapper valves to close the passage when propelled in an aft direction and to open the same when propelled forwardly;

the cable having ends with stirrups thereon; and a pulley wheel mounted on the bottom side surface of the platform forwardly of the cylinders, the cable having a midlength section trained about the pulley.

3. The invention of claim 2 wherein: the platform is formed of buoyant material.

4. The invention of claim 2 wherein:

the pistons each comprise a side wall, a central hub, and radial, spaced apart struts connecting the hub and the sidewall.

* * * * *